US009314088B2

(12) United States Patent
Lesch

(10) Patent No.: US 9,314,088 B2
(45) Date of Patent: Apr. 19, 2016

(54) CINCH SACK

(71) Applicant: Colin Lesch, Moscow, ID (US)

(72) Inventor: Colin Lesch, Moscow, ID (US)

( * ) Notice: Subject to any disclaimer, the term of this patent is extended or adjusted under 35 U.S.C. 154(b) by 206 days.

(21) Appl. No.: 14/139,735

(22) Filed: Dec. 23, 2013

(65) Prior Publication Data

US 2015/0173491 A1 Jun. 25, 2015

(51) Int. Cl.

| | |
|---|---|
| ***A45F 4/02*** | (2006.01) |
| ***A45F 3/04*** | (2006.01) |
| ***A45C 15/00*** | (2006.01) |
| *A44B 11/25* | (2006.01) |

(52) U.S. Cl.

CPC ..... *A45F 3/04* (2013.01); *A44B 11/2573* (2013.01); *A44B 11/2592* (2013.01)

(58) Field of Classification Search

CPC ..... A45F 3/04; A44B 11/2592
USPC ..... 224/656, 153, 576, 627, 638, 259; 383/72, 75; 24/115 G, 614, 615
See application file for complete search history.

(56) References Cited

U.S. PATENT DOCUMENTS

| | | | | | |
|---|---|---|---|---|---|
| 2,510,186 | A * | 6/1950 | Marsico | A45C 3/045 | 224/235 |
| 2,552,443 | A * | 5/1951 | Molinari | A45C 3/045 | 224/235 |
| 2,678,672 | A * | 5/1954 | Spilman | A45C 3/00 | 383/73 |
| 3,543,999 | A * | 12/1970 | Kugler | B65D 31/04 | 383/10 |
| 4,213,549 | A * | 7/1980 | Hibbard | A45F 3/04 | 224/153 |
| 4,328,605 | A * | 5/1982 | Hutchison | F16G 11/10 | 24/115 G |
| 4,453,292 | A * | 6/1984 | Bakker | F16G 11/10 | 24/115 G |
| 4,506,417 | A * | 3/1985 | Hara | F16G 11/00 | 24/115 G |
| 4,674,664 | A * | 6/1987 | Simon | A45F 3/04 | 224/153 |
| 4,675,948 | A * | 6/1987 | Bengtsson | F16B 2/22 | 24/115 G |
| 4,991,593 | A * | 2/1991 | LeVahn | A01N 1/02 | 128/853 |
| 5,187,823 | A * | 2/1993 | Ferguson | A45C 9/00 | 190/1 |
| 5,365,641 | A * | 11/1994 | Watanabe | A45C 13/1046 | 24/115 G |
| 5,490,619 | A * | 2/1996 | Boyar | A45F 3/02 | 150/103 |
| 5,961,014 | A * | 10/1999 | Knerr | A45F 3/04 | 224/153 |
| 5,964,642 | A * | 10/1999 | Fildan | A41F 1/006 | 2/323 |
| 5,979,722 | A * | 11/1999 | Gonzales | B62J 21/00 | 2/46 |
| 6,327,751 | B1 * | 12/2001 | Ikeda | F16G 11/10 | 24/115 G |
| 6,435,391 | B1 * | 8/2002 | Vazquez | A45C 13/1046 | 224/613 |
| 7,344,308 | B2 * | 3/2008 | Meyer | A63B 57/0087 | 383/41 |
| 8,132,298 | B2 * | 3/2012 | Chan | A43C 7/00 | 24/115 G |
| 8,181,320 | B2 * | 5/2012 | Wolfberg | A43C 7/08 | 24/115 G |
| 8,464,920 | B2 * | 6/2013 | Meyer | A45F 3/047 | 224/627 |

(Continued)

*Primary Examiner* — Justin Larson
*Assistant Examiner* — Lester L Vanterpool
(74) *Attorney, Agent, or Firm* — John Chandler

(57) ABSTRACT

Described are improvements related to a pack, backpack or sports sack for carrying items. In one implementation, a pack assembly includes a cinch sack, draw cords and a sternum or breast buckle for encouraging the pack assembly to remain in place on one's torso when in use. Improved shape, pockets and configuration of elements facilitate improved user experience and utility of the pack assembly.

20 Claims, 9 Drawing Sheets

(56) References Cited

U.S. PATENT DOCUMENTS

2004/0031129 A1 2/2004 Yang
2004/0155077 A1* 8/2004 Cullen ..... A45C 3/10 224/153
2005/0133559 A1* 6/2005 Daves ..... A45C 11/36 224/578
2006/0000856 A1 1/2006 West
2006/0151558 A1 7/2006 Higgins
2006/0153477 A1* 7/2006 Koguchi ..... A45C 9/00 383/14
2006/0218761 A1 10/2006 Anscher
2007/0080183 A1 4/2007 Lafoux et al.
2008/0115334 A1* 5/2008 Chen ..... A43C 1/00 24/115 G
2009/0020580 A1 1/2009 Tate
2009/0026098 A1* 1/2009 Tierney ..... A01M 31/008 206/315.11
2009/0159629 A1 6/2009 Lafoux et al.
2009/0205115 A1 8/2009 Chou
2011/0192875 A1* 8/2011 Nitti ..... A45C 9/00 224/575
2012/0192384 A1 8/2012 Kelly
2013/0101280 A1 4/2013 Xu

* cited by examiner

CINCH SACK

BACKGROUND OF INVENTION

1. Field

The present invention relates generally to a system and device for carrying equipment such as sports equipment and other items, and more particularly to a sports sack, bag or pack with an improved strap system and other improved features for carrying items.

2. Related Art

Carrying sacks, bags and packs come in a wide variety of forms and styles. A backpack style carrying pack may be useful for specific applications because it allows a user to quickly and conveniently throw a few items into it and allows the user to transport these items to and from a destination such as a play field, arena, gymnasium and the like.

Carrying packs for everyday training and participation in sports differ from general purpose backpacks, hiking packs, running harnesses and the like. For example, hiking packs often include heavy-duty features for securing and distributing loads evenly, pockets for water pouches, and other specialized compartments. School bags are made in generic shapes for carrying books, pencils, lunch and other supplies.

In contrast, cinch sacks are often designed for carrying lightweight and bulky single-purpose items such as athletic apparel, towels, cleated shoes, basketball shoes, and goggles, and small personal items like wallet, mobile phone and car keys. Often, sports packs are made with little attention to detail. They are made according to some rough dimensions and with generic, off-the-shelf components. Sometimes the components are forced to serve multiple purposes such as the straps in a drawstring backpack. In these types of packs, the carrying straps must double as drawstrings to control the principal opening at the top of the bag. Such design causes undue wear and breakdown of the fabric and stitching of the pack in certain areas. Such designs frequently neglect consideration of comfort, convenience and durability. While these packs may be designed to minimize manufacturing costs, the usability of these packs suffers. For example, the pack straps may have a tendency to slide off a user's shoulders, the cinching of the principal opening may be hard to accomplish and maintain, items may easily spill out and get lost, and the fit of the pack is ignored.

In view of the foregoing, it would be advantageous to provide a pack—a device and system—which improves upon known designs and known utility of sports packs.

SUMMARY

Systems and devices are described in relation to embodiments shown in the figures. Herein is provided a pack assembly configured to be worn on a wearer's back and over one or two shoulders. Straps or cords are coupled to the pack and are configured to extend over one or two of the wearer's shoulders. The straps may be formed of a pair of cords that run from the top of the pack to the respective bottom corners of the pack. The pack assembly also includes a sternum buckle or chest buckle to encourage continued and proper placement of the pack on the wearer's body. The sternum buckle includes a gripping or fastener to releasably engage with one or more of the cords or straps so as to retain a memory of its placement between wearings.

According to one embodiment, the straps or cords are arranged as a carrying feature and as drawstrings for the principal opening for the pack. A female portion and a male portion of a sternum buckle are releasably attached to respective straps or cords. The sternum buckle is intended for convenient and one-handed operation for fastening and unfastening, and for placement along the length of the straps or cords. The release mechanism to separate the male and female portions of the sternum buckle may also serve as the mechanism to release the engagement mechanism that releasably locks the female portion or the male portion to its respective strap or cord.

The described features and advantages will become more readily apparent to those of ordinary skill in the art by reference to the following Detailed Description and accompanying drawings. The teachings disclosed herein extend to embodiments that fall within the scope of the appended claims, regardless of whether they accomplish one or more of the described or inherent advantages.

This Summary introduces a non-exclusive selection of aspects or concepts about the present invention in a simplified form that are further described below in the Detailed Description. This Summary is not intended to identify essential features of the claimed subject matter, and is not intended to be used to limit the scope of the claimed subject matter.

BRIEF DESCRIPTION OF THE DRAWINGS

The novel features believed characteristic of the subject matter are set forth in the appended claims. Throughout, like numerals generally refer to like parts. The subject matter and any preferred mode of use are best understood by reference to the following Detailed Description of illustrative implementations when read in conjunction with the accompanying drawings.

DETAILED DESCRIPTION

There has been a need for improved systems and devices for carrying sports and other types of equipment and personal items.

Figure 1:
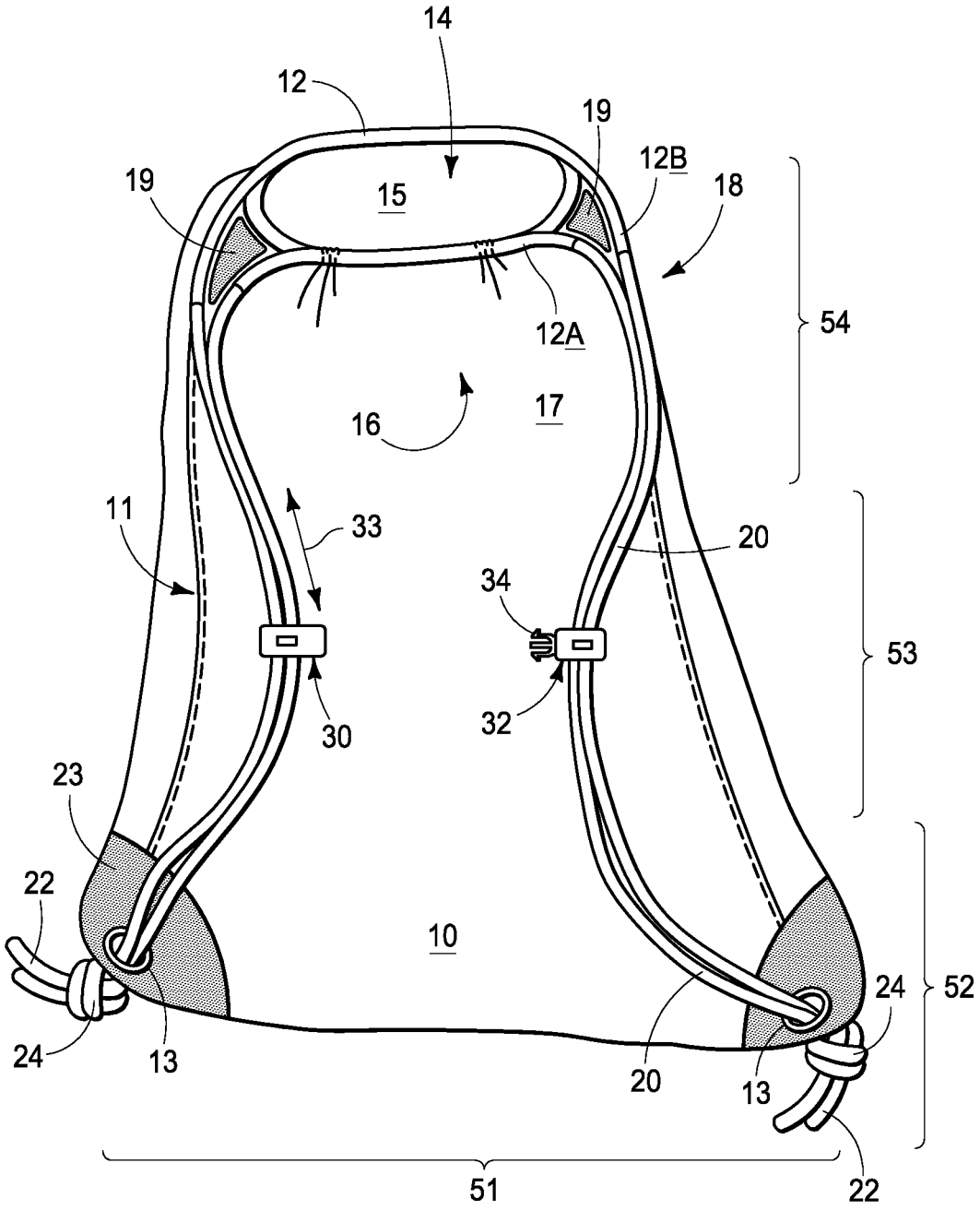
FIG. 1 is a perspective view of a pack according to a first illustrative implementation of the invention.

FIG. 1 is a perspective view of a pack according to a first illustrative implementation of the invention. With reference to FIG. 1, the pack or sack portion of the pack assembly is generally referred to as element 10. The pack 10 may include one or more seams such as vertical seams 11 that extend upwardly from bottom corners toward one or more cinches 12 that at least partially encircle a principal opening 14. The seams are generally where adjacent fabric pieces or material is sewn together to form portions of the pack. The pack 10 includes a front or anterior portion 16 and a back or posterior portion 18. The anterior portion 16 may or may not be made of the same material as that of the back or posterior portion 18. In one implementation, an anterior cinch portion 12A is shorter or allows one or more cords 20 to exit closer to the top opening 14 as compared to a posterior cinch portion 12B. This arrangement allows for improved, more ergonomic positioning of the cords 20 relative to a wearer's shoulders and neck, and thus provides for an improved fit, durability and useability of the cinch sack when in service.

The pack 10 has an inner surface 15 and an outer surface 17. The outer surface 17 of the anterior portion 16 generally lies against the back or shoulder of a wearer (not shown). At or near the openings of the cinch 12 is a gusset 19; there are two gussets 19 shown in FIG. 1, one adjacent each cinch 12. Each gusset 19 may be made of a same or a different fabric or material than that of the pack 10. In one implementation, the gusset 19 may be made of a mesh material so as to facilitate airflow through the pack 10. Logos, stitching, one or more textures and designs may adorn the anterior portion 16 and/or posterior portion 18 of the pack 10.

The pack assembly includes one, two or more straps or cords 20. Preferably, two cords 20 are used, each one forming part of the cinch 12 at the top of the pack 10. As shown in FIG. 1, each cord 20 is threaded through a grommet 13, up and through one or more passes of a cinch 12 or portion thereof, back down along its own length and through the same grommet 13. Preferably, a first cord is fed through the two passes of the cinch 12 in a first orientation, and the second cord is threaded through the two passes of the cinch 12 in an opposite or second orientation such that when the two or more cords 20 are pulled tight, the cinch 12 is drawn substantially closed and the principal opening 14 of the pack 10 is reduced. Preferably, the cords 20 are sufficiently thick in diameter so as to be comfortable on a wearer's shoulders. In a preferred implementation, each cord 20 is at least ⅜ inches (9.5 mm) in diameter. In some implementations, at least one of the cords is made of braided or woven strands of material. The ends 22 of the cord 20 are tied into a knot 24, stitched into the corner of the pack 10, or otherwise secured to the bottom portion 52 of the pack 10 or along a bottom width 51 of the pack 10. The lower portion of the pack 10 that includes the grommet 13 may include a reinforced portion 23 or may include a fabric or receive a chemical or coating treatment that strengths that particular portion of the pack to increase its durability and resist wear caused by use of the pack assembly.

In one implementation, on each cord 20, a female portion 30 and a male portion 32 of a chest buckle or sternum buckle are releaseably installed on respective straps or cords 20. The male portion 32 includes a locking portion 34 that releaseably engages with the female 30. Once installed, both the female portion 30 and the male portion 32 are independently moveable or slidable along the length 33 of the respective cords 20.

For most implementations, the bottom portion 52 of the pack 10 is preferably wider or larger than the middle portion 53 and the top portion 54. In other implementations, the middle portion 53 may be larger than the other two portions 52, 54, and the top portion 54 may be larger than the bottom portion 52 and middle portion 53.

Figure 2:
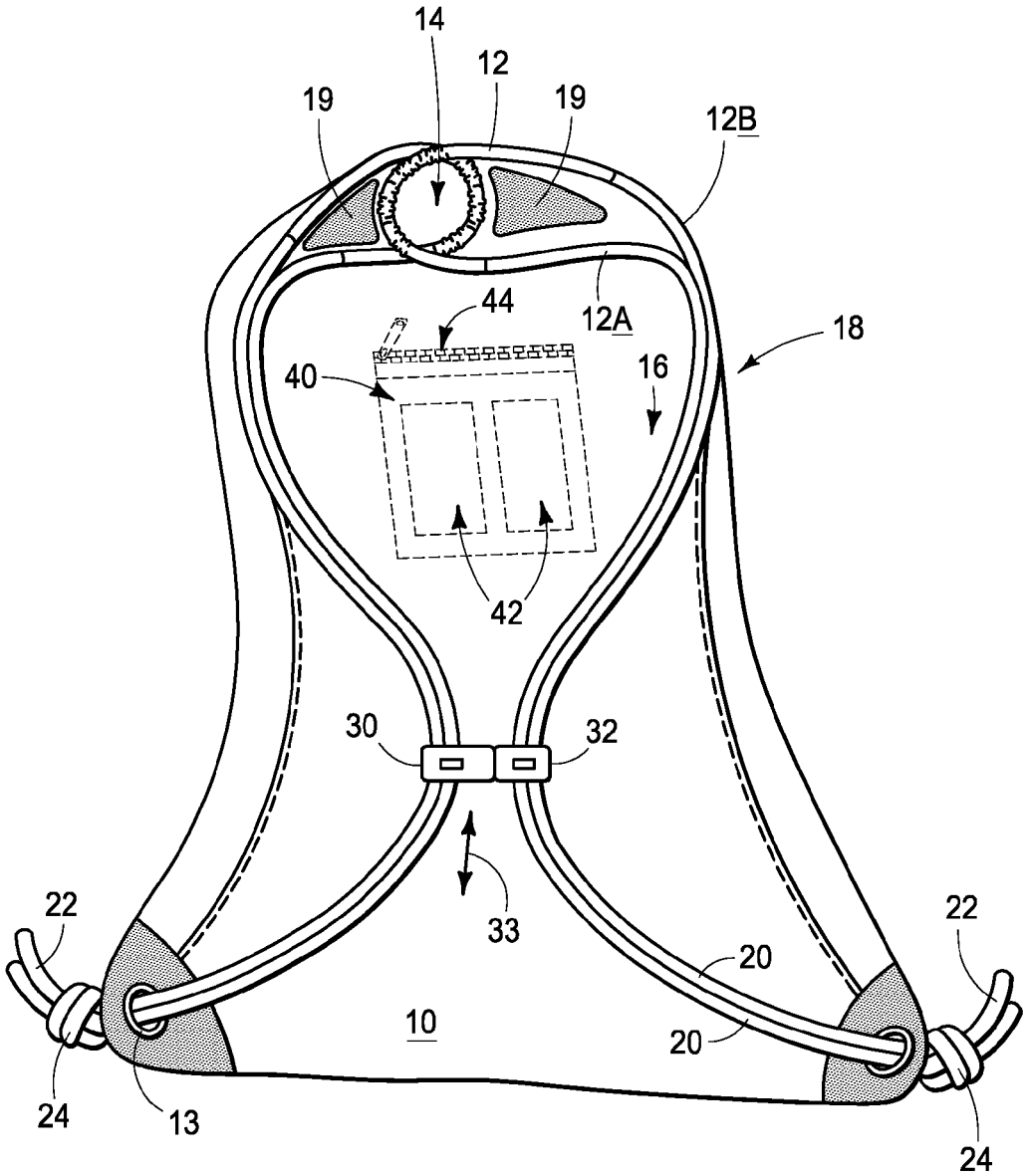
FIG. 2 is a perspective view of the pack shown in FIG. 1 in a different configuration.

FIG. 2 is a perspective view of the pack shown in FIG. 1 in a different configuration and with additional detail. With reference to FIG. 2, the portions of the sternum buckle 30, 32 have been mated together, and thereby the two straps or cords 20 are shown drawn closer together. The sternum buckle or chest buckle 30, 32 may or may not be slidable along a generally vertical axis 33, depending on the elements of the female portion 30 and the male portion 32 of the chest buckle, as explained further hereinbelow. The cords 20 are passed through the respective gussets 13, and the ends 22 of the cords 20 are tied into a knot 24. The top opening 14 has been drawn smaller by the closing or drawing of the cinch 12. A posterior cinch portion 12B extends farther away from opening 14 and cinch closure than an anterior cinch portion 12A to allow for the cords to more easily align together before passing together and toward the sternum buckle 30, 32. The gussets 19 are drawn farther up the pack 10 when the cinch 12 is in a more closed configuration.

A pocket 40 is shown hidden inside of the anterior side 16 of the pack 10. The pocket 40 is generally positioned medially in a vertical direction, and at least outside of the cinching portion of the pack 10, so as to avoid gathering or puckering the pocket 40 or moving the pocket 40 outside of a substantially vertical orientation when the pack is cinched and in service. Shown inside the pocket 40 are two personal items 42. Along the top of the pocket 40 is a zipper 44 that is representative of an optional closing element that may or may not be installed with use of the pocket 40. Other possible closing elements include hook and loop fasteners, snaps, and a fold-over flap. In FIG. 2, the pocket 40 is shown as a single pocket but may take the form of multiple pockets installed on or as part of pack 10 such as on the anterior portion 16 or posterior portion 18 of the pack 10. Each pocket 40 may be contiguous or separate from an adjacent pocket. Each pocket 40 may be divided into two or more sub-pockets.

Figure 3:
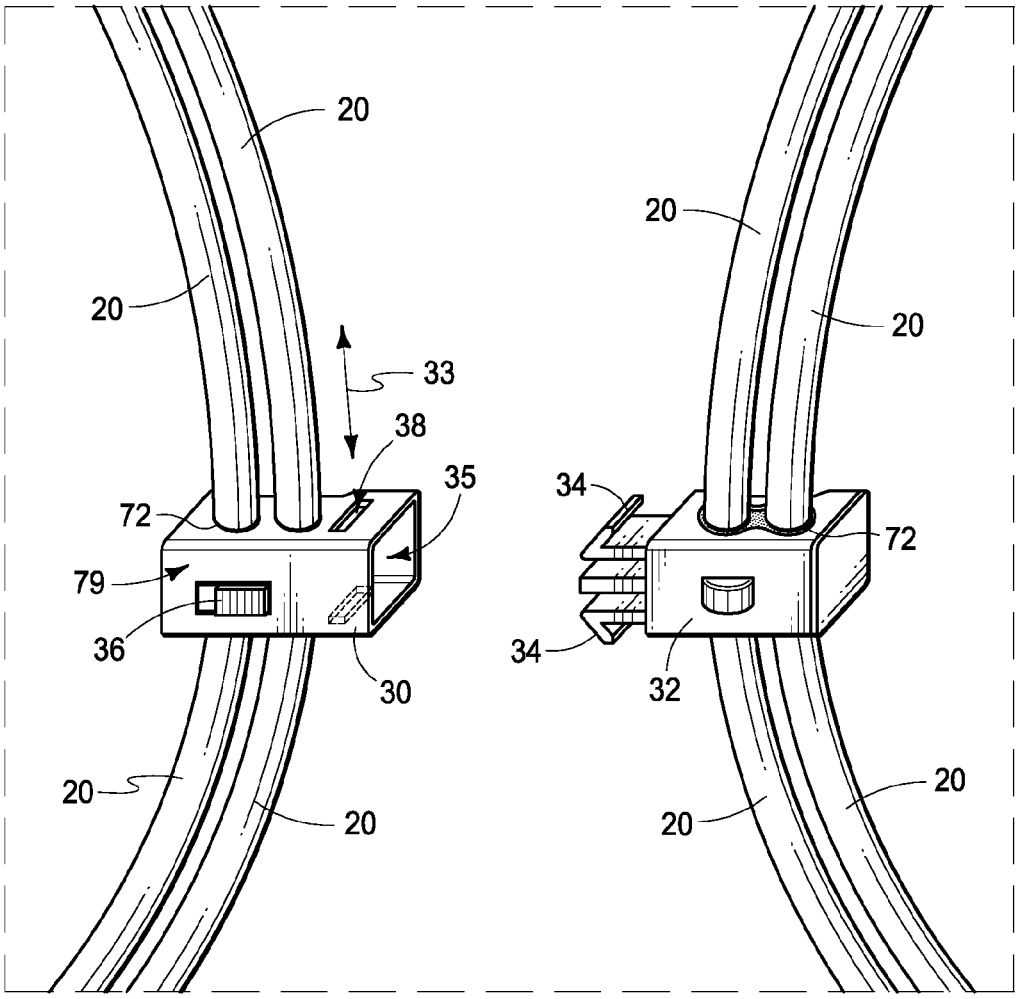
FIG. 3 is a perspective view of one implementation of a chest buckle according to a first illustrative implementation of the invention.

FIG. 3 is a perspective view of one implementation of a chest buckle according to a first illustrative implementation of the invention. With reference to FIG. 3, a female portion 30 and a male portion 32 of a chest buckle are shown. Two strands of the cords 20 pass through a portion of the female portion 30 and the male portion 32 of a chest buckle, respectively. In FIG. 3, the female portion 30 and male portion 32 are formed with individualized passages to allow for a single strand of the cord 20 to pass therethrough. An engaging or locking portion 34 of the male portion 32 of the buckle is insertable and matable with a recess 35 of the female portion 30 of the buckle. One or more of the engaging or locking portions 34 may engage in a respective aperture 38 formed in the female portion 30. A locking mechanism 36 is shown on the top surface 79 of the female portion 30 and the male portion 32. The locking mechanism 36 is shown as a rolling or sliding mechanism, and this locking mechanism 36 releaseably affixes the buckle portions 30, 32 to one or more passes of each respective cord 20. The locking mechanisms 36 prevent the buckle portions 30, 32 from moving along a length or vertical stretch 33 of the cords.

Figure 4:
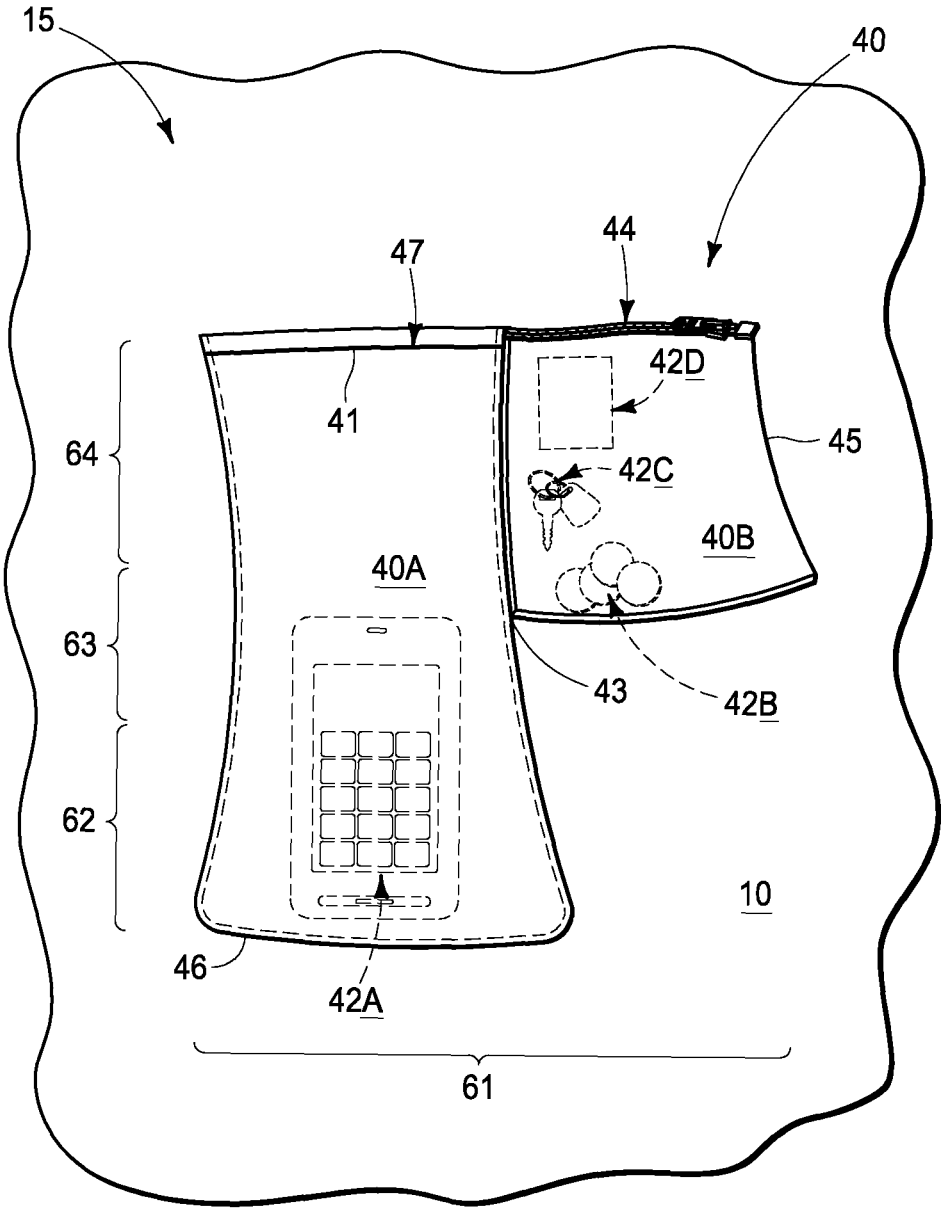
FIG. 4 is a perspective view of interior pockets of a pack according to a first illustrative implementation of the interior pockets.

FIG. 4 is a perspective view of interior pockets of a pack according to a first illustrative implementation of the interior pockets. There has been a need for improved features of a pack, and features of interior pockets are one of many areas in which this need is evident. With reference to FIG. 4, a pocket 40 has been divided by a dividing seam 43 into a first sub-pocket 40A and a second sub-pocket 40B. The second sub-pocket 40B is shown shorter vertically than the first sub-pocket 40A. This is by design to provide sub-pockets of various shapes and design to accommodate various items in the pack 10. Alternatively, the sub-pockets 40A, 40B may be of generally the same size, height and width. The first sub-pocket 40A includes a top edge 41 and forms an opening 47 near the top edge 41. The first sub-pocket 40A is shown with a mobile phone 42A disposed therein. In one implementation, the material of the pocket 40 is made of an elastic or stretchy material that may be substantively different than the material of the pack 10. For example, the material may be a material similar to a Lycra® or Neoprene® material. Such material, besides being elastic also provides an increased ability to cushion shocks to the contents of the pocket 40 and subpockets 40A, 40B. The elastic material provides a gripping surface (and a higher degree of friction when in contact with the items) that more readily maintains the items in the sub-pockets 40A, 40B. Further, the elastic material provides a retaining force to effectively pinch items between the sub-pocket 40A and pack 10. Alternatively, while not shown in FIG. 4, a pocket 40 may be made from two overlapping layers of an elastic material—one layer as the outer layer and one layer as an inner layer that lays flush against and is continuous with the material of the pack 10. Also according to another variation, the pocket 40 may be lined with a cushioning material in addition to a fabric to further provide cushioning and gripping of items. Often, a user of a pack assembly carries high value items in the pocket 40 and these items need increased protection against the contents of the main compartment of the pack assembly, and against drops and rough handling that sometimes accompanies trips to sporting activities and the like.

The second sub-pocket 40B is shown with a zippered closing mechanism 44. In this way, a pack assembly user has the option of placing items such as coins 42B, car keys 42C and a wallet 42D into an enclosed sub-pocket 40B for additional security that these items will not escape the pack assembly. In an alternative embodiment, another type of closing mechanism may be used such as a hook-and-loop closure, or a snap closure. In yet another alternatively embodiment, the closure mechanism 44 may extend across the entire pocket 40.

The shape of the pocket 40 may take any one of various shapes and dimensions to accommodate certain frequently carried items and provide other benefits. The pocket 40 in FIG. 4 is shown as a substantially hourglass shape. The pocket 40 has two lateral sides 45 and a bottom side 46. For the hourglass shape, a bottom pocket region 62 is wider than a middle pocket region 63, and a top pocket region 64 is wider than the middle pocket region 63. Other configurations and embodiments may be possible. For example, the top pocket region 64 may be wider than both the middle pocket region 63 and the bottom pocket region 62. The orientation of the pocket 40 may not be justified or aligned vertically or horizontally in the pack 10. Instead, the pocket 40 may by affixed to the inner surface 15 in one or more various pocket regions 61. Each pocket 40 may be formed into two or more sub-pockets; only two sub-pockets 40A, 40B are shown in FIG. 4. In an alternative implementation, the pocket 40 may be formed or affixed to a bottom region 51 (as shown in FIG. 1).

Figure 5:
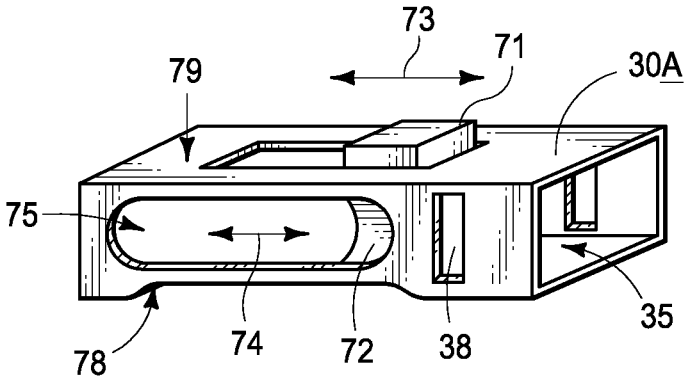
FIG. 5 is a perspective view of a female portion of a chest buckle according to a first illustrative implementation.

FIG. 5 is a perspective view of a female portion of the chest buckle according to a first illustrative implementation. With reference to FIG. 5, a female portion 30A is formed or assembled to include a recess 35 and an aperture 38 for receiving a portion and engaging element of a male buckle portion (not shown). The female portion 30A also includes a sliding element 71 and a cord engaging element 72. The sliding element 71 is designed to be handled and operated with a single hand of a user, and preferably, a single motion. The sliding element moves laterally along a range of motion 73. Although not shown in FIG. 5, there may also be included one or more integral or separate biasing elements that provide a biasing force to restrict an aperture 75 for one or more passes of a cord (not shown in FIG. 5). In operation, the cord engaging element 72 contacts with and provides a restrictive and releaseably engaging force to one or more passes of the cords of the pack. In this way, the female portion 30A releaseably maintains its position long the length of the cord or cords. The pack assembly thus has a memory for its configuration for a user. For sake of simplicity, the female portion 30A is shown with a flat bottom surface 78 and a flat top surface 79. However, depending on the particular implementation, the bottom surface 78 and top surface 79 may be contoured, shaped or textured with a same or different material, or the same material of the bottom surface 78 may be so contoured, shapped or textured. Further, the sliding element 71 is shown as a simple block shape, but preferably is ergonomically shaped so as to provide a comfortable scalloped recess for a finger to easily and conveniently find, engage and operate the sliding element 71.

Figure 6:
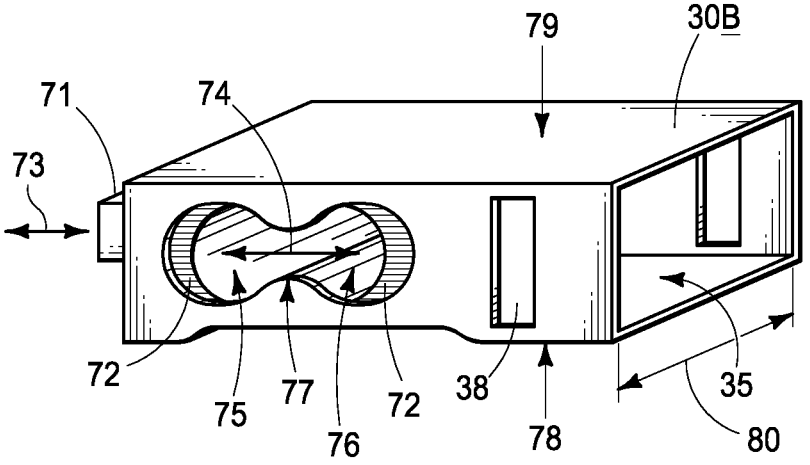
FIG. 6 is a perspective view of a female portion of a chest buckle according to a second illustrative implementation.

FIG. 6 is a perspective view of a female portion of the chest buckle according to a second illustrative implementation. With reference to FIG. 6, the sliding element 71 is formed or located on a side opposite that of the recess 35. An aperture 38 for an engaging element of a male buckle portion is shown on a first side; it is to be understood that a matching aperture is located on the non-displayed side of FIG. 6. While a single aperture 38 is shown, other numbers, configurations and arrangement of apertures 38 may be used to secure the two portions of a chest buckle together when the two portions are engaged. The sliding element 71 of the female portion 30B is operated by pressing it inward along its range of motion 73 that is parallel with or along the principal axis of the female portion 30B. The sliding element 71 may be the same or different from the cord engaging element 72. Two cord engaging elements 72 are shown in FIG. 6. The cord engaging elements 72 restrict the aperture for the one or more passes of the cord (not shown in FIG. 6). While not shown, the female portion 30B includes one or more biasing elements that provide a closing force along the range of motion 74 of the cord engaging elements 72. By moving the sliding element 71 inward, the cord engaging elements 72 move outwardly thereby providing freedom for the cords (not shown) and allowing the female buckle portion 30B to move along the length of one or cords that pass through the aperture. The aperture is divided or shaped into a first aperture region 75 and a second aperture region 76 by a raised contour 77. The raised contour 77 preferably extends through the width 80 of the female buckle portion 30B. The contour 77 provides a mechanical separation and alignment of two or more cords in the aperture of the female portion 30B. In this way, the cords of a pack assembly are kept from twisting and becoming uncomfortably positioned on a user during use. For sake of simplicity, the female portion 30B is shown in FIG. 6 with a flat bottom surface 78 and a flat top surface 79. However, depending on the particular implementation or embodiment, the bottom surface 78 and top surface 79 may be contoured, shaped or textured.

Figure 7:
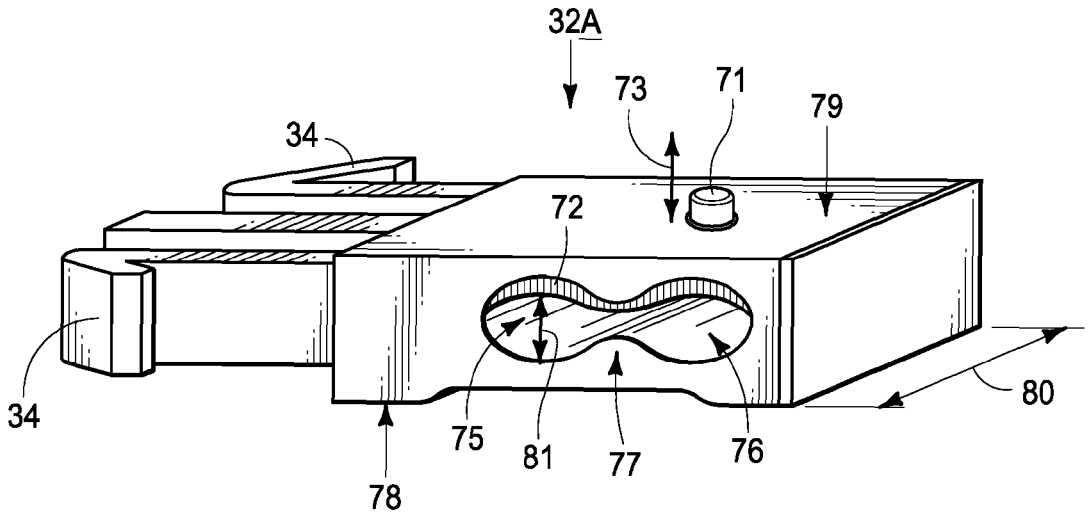
FIG. 7 is a perspective view of a male portion of a chest buckle according to a third illustrative implementation.

FIG. 7 is a perspective view of a male portion of a chest buckle according to a third illustrative implementation. With reference to FIG. 7, a male portion 32A includes a sliding element 71 that is formed, installed or located through or in association with a top surface 79. The male buckle portion 32A includes one or more male engaging portions; two male engaging or locking portions 34 are shown in FIG. 7. These engaging or locking portions 34 releaseably engage into the recess and apertures of a female buckle portion (not shown in FIG. 7). The sliding element 71 of the male buckle portion 32A is operated by pressing it downward along its range of motion 73 that is shown perpendicular to the principal axis of the male buckle portion 32A. The sliding element 71 may be the same or part of the cord engaging element 72, or may be a separate, different element from the cord engaging element 72. Two cord engaging elements 72 are shown in FIG. 7 for illustrative purposes only. One or more cord engaging elements 72 may be present in the third illustrative implementation. The cord engaging elements 72 restrict the aperture for the one or more passes of the cord (not shown in FIG. 7). While not shown, the male portion 32A includes one or more biasing elements that provide a closing force along the range of motion 81 of the cord engaging elements 72. By moving the sliding element 71 inward or downward, the cord engaging elements 72 move outwardly thereby providing freedom for the cords (not shown) and allowing the male buckle portion 32A to move along the length of one or cords that pass through the aperture. The aperture is divided or shaped into a first aperture region 75 and a second aperture region 76 by a raised contour 77. The raised contour 77 preferably extends through the width 80 of the male buckle portion 32A. The contour 77 provides a mechanical separation and alignment of two or more cords in the aperture of the male portion 32A; only two aperture regions 75, 76 are shown but multiple aperture regions may be provided depending on the number of passes of the cords that are desired to be passed through the male buckle portion 32A—in such case, multiple contours 77 may be needed and formed in the male buckle portion 32A. In this way, the cords of a pack assembly are kept from twisting and becoming uncomfortably positioned on a user during use. For sake of simplicity, the male portion 32A is shown in FIG. 7 with a flat bottom surface 78 and a flat top surface 79. However, depending on the particular implementation or embodiment, the bottom surface 78 and top surface 79 may be contoured, shaped or textured.

Figure 8:
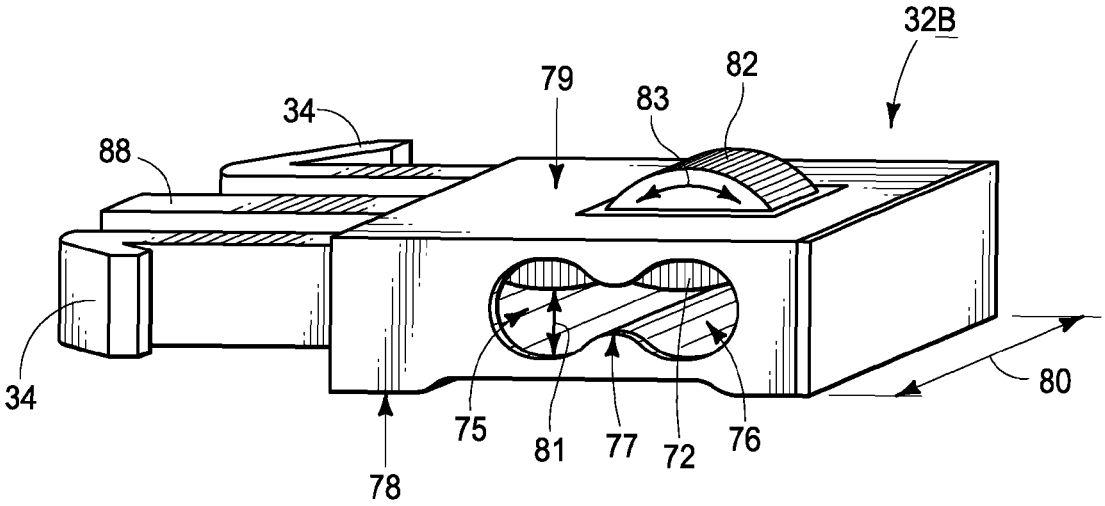
FIG. 8 is a perspective view of a male portion of a chest buckle according to a fourth illustrative implementation.

FIG. 8 is a perspective view of a male portion of a chest buckle according to a fourth illustrative implementation. With reference to FIG. 8, a male portion 32B includes a rolling element 82 that rolls back and forth in circular or rocking motion or direction 83. As shown in FIG. 8, the rolling element 82 protrudes above a top surface 79. The male buckle portion 32B includes one or more male engaging portions; two male engaging portions 34 are shown in FIG. 8 along with a stabilizing center post 88. These engaging portions 34 releaseably engage into the recess and apertures of a female buckle portion (not shown in FIG. 8). The rolling element 82 of the male buckle portion 32B is operated by engaging it with a thumb or finger and providing a rolling or sliding motion. The rolling element 82 engages one or more cord engaging elements 72. One cord engaging element 72 is shown in FIG. 8. The rolling element 82 may be the same or part of the cord engaging element 72, or may be a separate, different element from the cord engaging element 72. The cord engaging element 72 restricts the aperture for the one or more passes of the cord (not shown in FIG. 8). While not visible or shown in FIG. 8, the male buckle portion 32B includes one or more biasing elements that provide a closing force along the range of motion 81 of the cord engaging element 72. By moving the rolling element 82, the cord engaging element 72 moves upwardly thereby providing freedom for the one or more cords (not shown for sake of simplicity) and allowing the male buckle portion 32B to move along the length of one or cords that pass through the aperture. The aperture is divided or shaped into a first aperture region 75 and a second aperture region 76 by a raised contour 77. The raised contour 77 preferably extends through the width 80 of the male buckle portion 32B. The contour 77 provides a mechanical separation and alignment of two or more cords in the aperture of the male portion 32B; only two aperture regions 75, 76 are shown but multiple aperture regions may be provided depending on the number of passes of the cords. For sake of simplicity, the male portion 32B is shown in FIG. 8 with a flat bottom surface 78 and a flat top surface 79. However, depending on the particular implementation or embodiment, the bottom surface 78 and top surface 79 may be contoured, shaped or textured.

Figure 9:
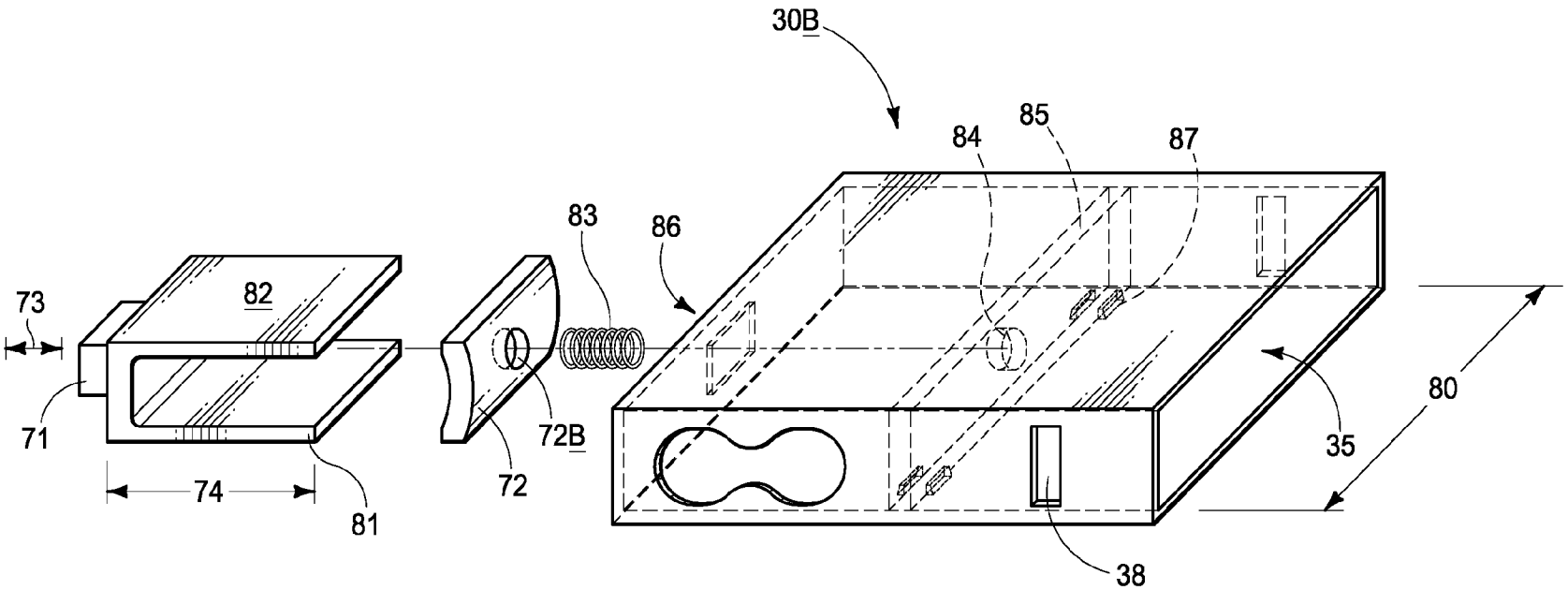
FIG. 9 is an exploded view of the female portion of the chest buckle shown in FIG. 6.

FIG. 9 is an exploded view of the female portion of the chest buckle shown in FIG. 6. With reference to FIG. 9, and according to one of many possible embodiments of the female buckle portion 30B, the sliding element 71 includes one or more extended tabs 82 that are designed to engage a cord engaging element 72. In FIG. 9, only one cord engaging element 72 is shown for simplicity. The sliding element 71 is designed to be securely and moveably inserted into an aperture 86 in the side opposite the principal buckle recess 35. The sliding element 71 protrudes a small distance through its aperture 86. In operation, the movement of the sliding element or detent 71 is generally along a horizontal, sliding axis or range of motion 74. The cord engaging element 72 is placed adjacent to the extended tabs 82 and is held in place by a spring or other biasing element 83. A spring 83 is shown, but other types, varieties and methods may be implemented to bias the cord engaging element 72 inside the female buckle portion 30B. The spring 83 engages and is mated with a recess or designated place or feature 84 on an insert 85. The insert 85 is maintained in place by one or more ridges 87. When the detent 71, cord engagement element 72, and spring 83 are inserted, the insert 85 is placed inside the buckle portion 30B with the intent that the buckle portion 30B is assembled and is not designed to be disassembled when placed into service as part of the pack assembly. As also shown in FIG. 6, an aperture 38 is formed in the female buckle portion 30B for receiving an engaging element of a male buckle portion (not shown in FIG. 9). When assembled, the sliding element 71 is operated by pressing it inward along its range of motion 73 that is parallel with or along the principal axis of the female portion 30B. The detent range of motion 73 may or may not be the same as the range of motion of the cord engaging element 72 based on the particular implementation of components used in practice. However, for sake of simplicity of illustration in FIG. 9, these ranges are the same because the motion of the detent 71 is based on the same mechanical motion as that of the cord engaging element 72 because they both are based on the biasing of the same spring element 83. In alternative implementations, the sliding element 71 is connected to and forms the same part as the cord engaging element 72. By moving the sliding element or detent 71 inward, the cord engaging element 72 moves or slides to the right thereby freeing itself from pressing on one or more cords, and thereby providing freedom for the cords (not shown). In this way, in operation, the female buckle portion 30B is free to move along the length of one or cords that pass through the aperture. While shown as straight arms, the extended tabs 82 may be or are required to be contoured to fit the shape of the first aperture 75 and second aperture 76. For sake of simplicity, the female portion 30B is shown in FIG. 9 with a flat bottom surface 78 and a flat top surface 79. However, depending on the particular implementation or embodiment, the bottom surface 78 and top surface 79 may be contoured, shaped or textured.

Figure 10:
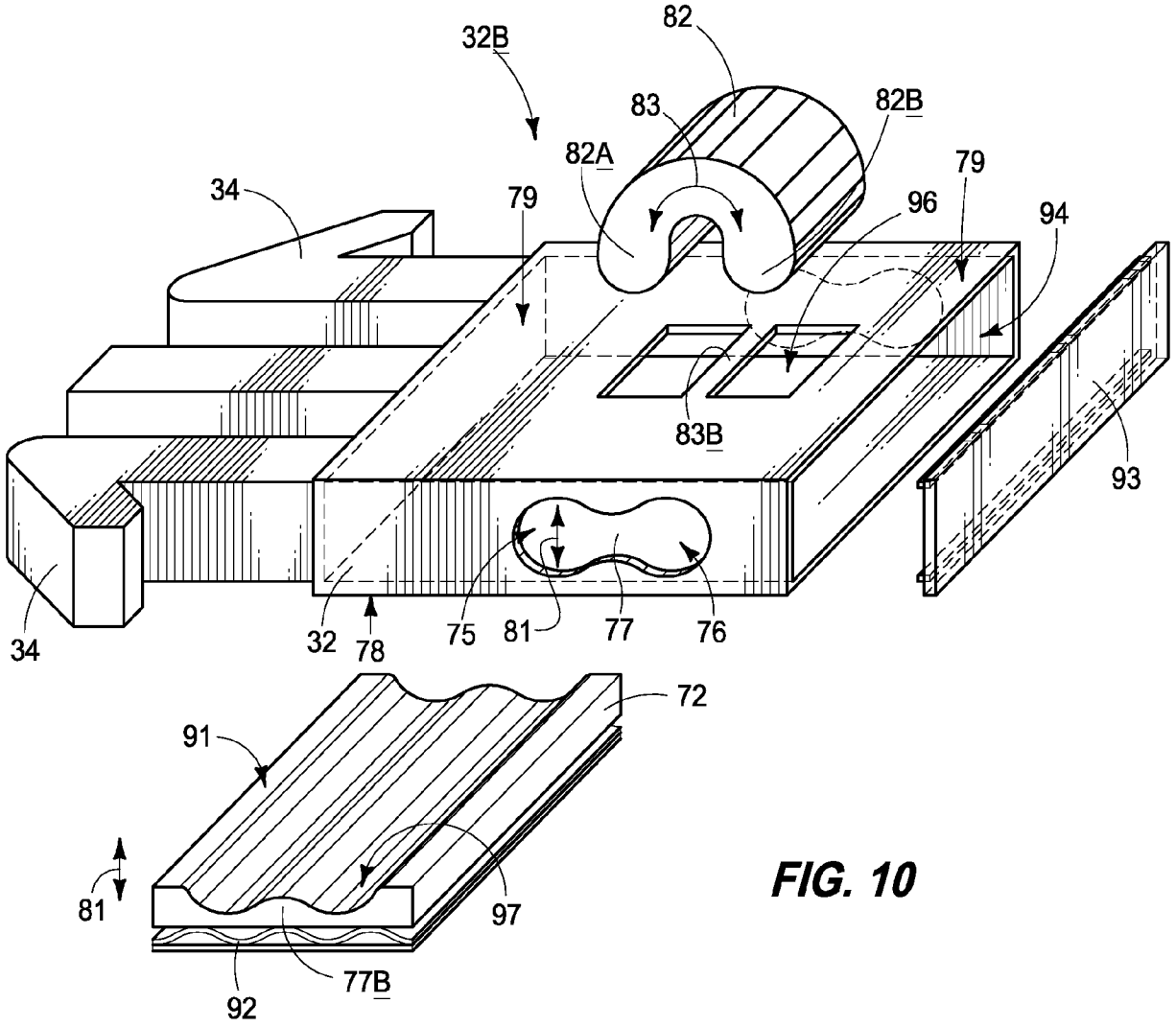
FIG. 10 is an exploded view of the male portion of the chest buckle shown in FIG. 8.

FIG. 10 is an exploded view of the male portion of the chest buckle shown in FIG. 8. With reference to FIG. 10, and according to one of many possible embodiments of the male buckle portion 32B, the rolling element 82 is formed so as to snap over and onto an axle 83B or other axis-forming element. On either side of the axle 83B are two recesses 96 for receiving portions 82A, 82B of the rolling element 82 that protrude into the inner, hollow portion of the male buckle portion 32B. A single cord engaging element 72 is shown. A first protruding part 82A is designed to engage a mating portion 91 of the cord engaging element 72. When assembled and in operation, by rolling or moving the rolling element 82, the rolling element 82 moves according to a range of motion 83, and the first protruding part 82A pushes downward onto the mating portion 91 of the cord engaging element 72. The cord engaging element 72 presses downward against a biasing spring panel 92. The biasing spring panel 92 provides a closing or clamping (upward) force against one or more cords (not shown) that pass through the first aperture 75 and second aperture 76. In FIG. 10, only one cord engaging element 72 is shown for simplicity, but other numbers and types of cord engaging elements 72 are possible when used in conjunction with a rolling element 82. A single biasing spring panel 92 is shown, but other types, varieties and methods may be implemented to bias the cord engaging element 72 inside the male buckle portion 32B. The male buckle portion 32B is assembled by inserting the cord engaging element 72 and biasing spring panel 92 into the inner recess 94 of the male buckle portion 32B. The inner recess 94 is closed from further access by placing a panel 93 into the end portion of the male buckle portion 32B. The various components (e.g., cord engaging element 72, biasing spring panel 92 and panel 93) may be held in place or within a range of motion by one or more ridges, lips, or rails (not shown for sake of simplicity) formed in the male buckle portion 32B. The panel 32 is meant to snap into place and the male buckle portion 32B is not meant to be re-opened again after being placed into service. That is, after being assembled, the male buckle portion 32B is not designed to be disassembled when placed into service as part of the pack assembly. When assembled, the rolling element 82 is operated by placing a finger or thumb on it, and rolling the rolling element 82 toward the engaging elements 34. The cord engaging element 72 moves along its range of motion 81 when the rolling element 82 is operated. The range of motion 81 is perpendicular to the principal axis of the male buckle portion 32B. The rolling range of motion 83 may or may not be the same as the range of motion of the cord engaging element 72 based on the particular implementation of components used in practice. However, for sake of simplicity of illustration in FIG. 10, these ranges are approximately the same because the motion of the rolling element 82 is based on the same mechanical motion as that of the cord engaging element 72 because they are both based on the biasing of the same biasing spring panel 92. By moving the rolling element 82, the cord engaging element 72 moves or slides downward thereby freeing itself from pressing on one or more cords, and thereby providing freedom for the cords (not shown). In this way, in operation, the male buckle portion 32B is free to move along the length of one or cords that pass through the aperture. As shown, the cord engaging element 72 is formed so as to match the shape of the first aperture portion 75 and second aperture portion 76 including having a raised contour 77B. In one implementation, the cord engaging element 72 is made from a friction-inducing material or substance such that the cords (not shown) and the cord engaging element 72 aggressively grip each other when a biasing force is applied to the cord engaging element. For example, the buckle portion 32B may be made of a polyvinyl material, the cords may be made of a Nylon® or natural or synthetic fiber, and the cord engaging component 72 may be made of a rubber or rubber-like component. The inner surface 97 of the cord engaging element 72 may be textured or shaped so as to provide a desired amount of gripping of the cord when the cord engaging element 72 is biased against the cords (not shown in FIG. 10). As noted elsewhere herein, for sake of simplicity, the male portion 32B is shown in FIG. 10 with a flat bottom surface 78 and a flat top surface 79. However, depending on the particular implementation or embodiment, the bottom surface 78 and top surface 79 may be contoured, shaped or textured.

Figure 11:
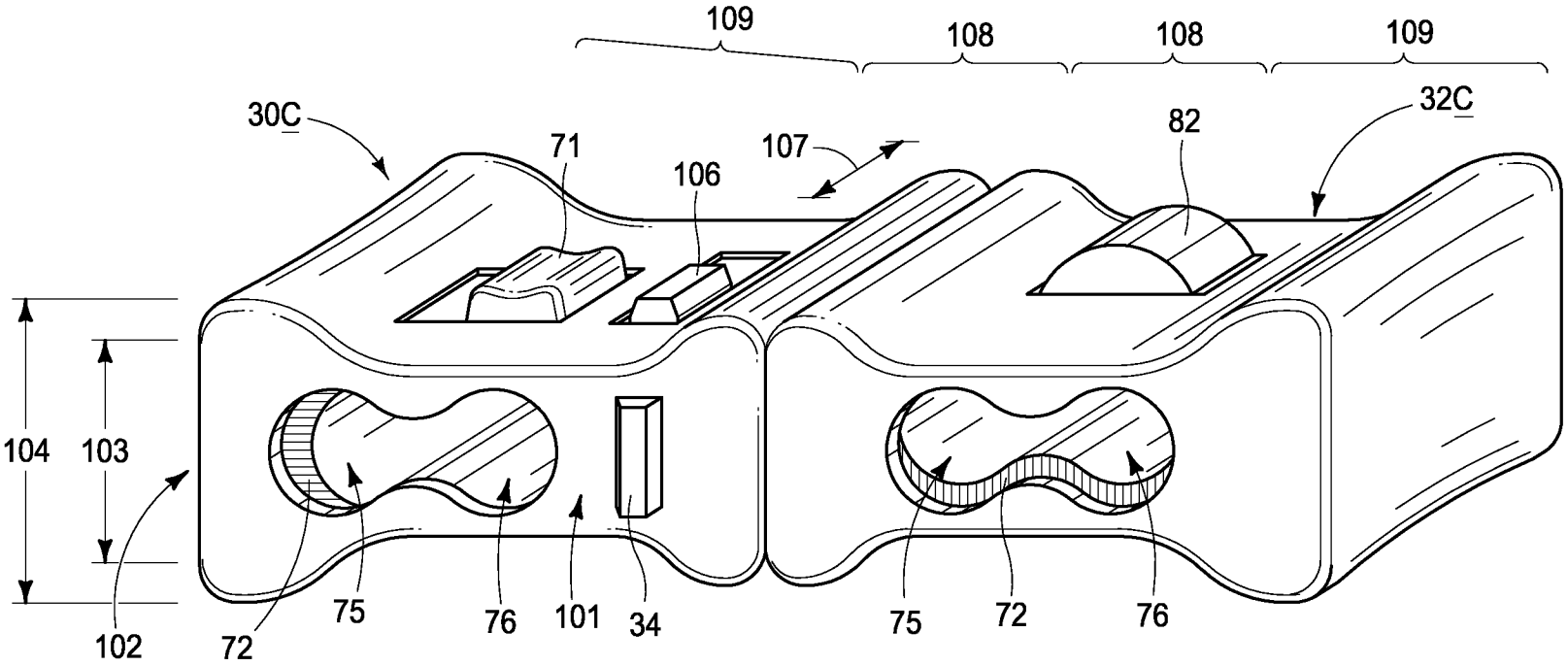
FIG. 11 is a perspective view of an assembled chest buckle according to another illustrative implementation showing both a female buckle portion and a male buckle portion.

FIG. 11 is a perspective view of an assembled chest buckle according to another illustrative implementation showing both a female buckle portion and a male buckle portion. With reference to FIG. 11, a male buckle portion 32C has been engaged into a female buckle portion 30C. an engaging or locking portion 34 is visible protruding through an aperture of the female buckle portion 30C. A release element 106 may be actuated along a range of motion 107 which frees the locking portions 34, and the male buckle portion 32C may be disengaged and released from the female buckle portion 30C. Actuating a sliding element 71 moves the cord engaging element 72 of the female buckle portion 30C. Actuating a rolling element 82 moves the cord engaging element 72 of the male buckle portion 32C. The first apertures 75 and second apertures 76 are visible in both the male buckle portion 32C and the female buckle portion 30C. The distal portions 109 are larger than the proximal portions 108 of each of the male buckle portion 32C and the female buckle portion 30C—as is evident when considering the buckle portions from a top view and from a front view. As visible from a front perspective, the proximal portions 108 are smaller in dimension 103 than the distal dimension 104 of the distal portions 109. That is, according to the embodiment shown, the chest buckle or sternum buckle forms a rounded, contoured dog bone-shaped assembly. This assembly is designed to be manipulated with a single hand and each function or mechanism is designed to be actuated with a simple movement or action—such as to the sliding element 71, rolling element 82 and release element 106.

Variations.

While the invention is described with respect to one or more illustrative or preferred implementations, other implementations are possible. The concepts disclosed herein apply equally to other systems, devices and methods for packs, sacks, carrying devices and the like. The invention is described with reference to the accompanying drawings where it is noted that characteristics and features shown in the drawings are not drawn to scale.

Not all structures require all components. For example, one or more interior pockets may or may not vary in shape along their length or breadth. The sack portion of the pack may or may not vary in width along its length from top to bottom. In the figures, cords are shown passed through respective grommets at the bottom corners of the sacks, the ends of the cords being knotted. Such is not required. Other fasteners, connections and arrangements are possible. Further, other shapes and arrangements besides those shown in the figures are possible, such as triangular or trapezoidal shaped sacks, etc.

Further, certain terms used herein, including in the claims, are generally intended as "open" terms (e.g., the term "including" should be interpreted as "including but not limited to," the term "includes" should be interpreted as "includes but is not limited to," and the term "having" should be interpreted as "having at least.") It will be further understood by those within the art that if a specific number of an introduced claim recitation is intended, such an intent will be explicitly recited in the claim, and in the absence of such recitation no such intent is present.

For example, as an aid to understanding, the following claims may contain usage of the introductory phrases "at least one" and "one or more" to introduce claim recitations. The use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and "an" should typically be interpreted to mean "at least one" or "one or more"). The same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C," is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.).

It will be further understood by those within the art that any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Moreover, "can" and "optionally" and other permissive terms are used herein for describing optional features of various embodiments. These terms likewise describe selectable or configurable features generally, unless the context dictates otherwise.

The described aspects of the invention depict different components contained within, or connected with, different other components. It is to be understood that such depicted architectures are merely illustrative, and that in fact many other architectures can be implemented which achieve the same functionality.

The foregoing discussion has been presented for purposes of illustration and description. Various features from one implementation can be combined with other features from other implementations. The description is not intended to limit the invention to the form or forms disclosed herein. Consequently, variation and modification commensurate with the above teachings, within the skill and knowledge of the relevant art, are within the scope of the present invention. The implementations described herein and above are also intended to explain the best mode presently known of practicing the invention and to enable others skilled in the art to use the invention, or in other implementations, and with the various modifications required by their particular application or uses of the invention. It is intended that the appended claims be construed to include alternate implementations to the extent permitted. Thus, the appended claims are to encompass within their scope all variations and modifications as are within the spirit and scope of this subject matter described herein.

I claim:

1. A pack assembly comprising:

a sack portion configured to be worn over a wearer's shoulder or back, wherein the sack portion includes:

a material formed into a top opening for and through which items are received into the sack portion;

a closing cinch formed in the material and around a periphery of the top opening;

an outside surface; and an inside surface;

a first cord and a second cord coupled to said sack portion, said cords facilitating carrying of said pack assembly; and a sternum buckle including:

a female buckle component, wherein the female component forms a bi-lobal aperture through the female buckle component for receiving two passes of the first cord, and wherein the female component forms a raised contour between the lobes of its aperture for maintaining the two passes of the first cord aligned through the female buckle component, one pass in each lobe of the aperture, and wherein the female buckle component includes a top surface and a bottom surface, the bottom surface for laying generally against a user's chest, and wherein the bottom surface is shaped so as to form a first thickness and a second thickness as measured along the bottom surface and between the bottom surface and top surface of the female buckle component, and wherein the first thickness is smaller than the second thickness; and a male buckle component, wherein the male component forms a bi-lobal aperture through the male buckle component for receiving two passes of the second cord, and wherein the male buckle component is formed so as to engage with and re-movably mate with the female buckle component, and wherein the male component forms a raised contour between the lobes of its aperture for maintaining the two passes of the first cord aligned through the male buckle component, one pass in each lobe of the aperture, and wherein the male buckle component includes a top surface and a bottom surface, the bottom surface for laying generally against a user's chest, and wherein the bottom surface is shaped so as to form a first thickness and a second thickness as measured along the bottom surface and between the bottom surface and top surface of the male component, and wherein the first thickness is smaller than the second thickness.

2. The pack assembly of claim 1, and wherein the sack portion is shaped wider at a bottom region than at its top region, and wherein the top region is wider than its mid region.

3. The pack assembly of claim 1, wherein the inside surface of the sack portion includes a pocket; and wherein the pocket includes a top edge, a first side, a second side and a bottom side; and wherein the pocket is wider at the bottom side than at the top edge.

4. The pack assembly of claim 3, wherein the pocket includes a closure mechanism to reversibly secure the top edge of the pocket to the inside surface of the sack portion.

5. The pack assembly of claim 1, wherein the female buckle component is a single molded piece.

6. The pack assembly of claim 1, wherein the securing lock of the female buckle component includes a sliding element for manual operation.

7. The pack assembly of claim 1, and wherein each cord extends from a respective bottom corner of the sack portion, threads through and forming part of the closing cinch of the sack portion, and extends back to its respective bottom corner of the sack portion, and wherein the female buckle component includes a securing lock configured to releasably secure the female buckle component to a location along the two passes of the first cord, and wherein the securing lock engages at least one of the two passes of the first cord.

8. The pack assembly of claim 7, wherein the securing lock of the female buckle component includes a spring to facilitate the releasable securing of the female buckle component to a location along the two passes of the first cord.

9. The pack assembly of claim 1, wherein the securing lock of the female buckle component restricts the aperture for the two passes of the first cord.

10. The pack assembly of claim 1, wherein the securing lock of the male buckle component is operated independently of the operation male buckle component with respect to the female buckle component.

11. A pack assembly comprising:

a pack formed from a fabric into an enclosable compartment and configured to be worn on a wearer, said pack including a first side, an opposite second side, and wherein the fabric is formed into an opening in the pack for receiving one or more items to be carried;

two cords coupled to said pack and configured to extend over a portion of the wearer, said cords including a first cord coupled to said first side of said pack and a second cord coupled to said second side of said pack;

a chest buckle configured to retain the at least two cords including:

a female portion having a first surface for lying against the wearer, and wherein the female portion includes a retaining portion formed with a bi-lobal passage therethrough, the retaining portion including a raised contour in the passage that separates the lobes, and wherein two passes of the first cord pass through the respective lobes of the bi-lobal passage being separated by the raised contour, and wherein the first surface is contoured to form a gap between the female portion and wearer, and wherein the female portion of the chest buckle also includes a receiving end for receiving a male portion of the chest buckle, the receiving end being opposite of said retaining portion; and the male portion having a first surface for lying against the wearer, and wherein the male portion includes a retaining portion formed with a bi-lobal passage therethrough, the retaining portion including a raised contour in the passage that separates the lobes, and wherein two passes of the second cord pass through the respective lobes of the bi-lobal passage being separated by the raised contour, and wherein the first surface is contoured to form a gap between the male portion and wearer, and wherein the male portion also includes a male portion for engaging with the receiving end of the female portion of the chest buckle.

12. The pack assembly of claim 11, and wherein the retaining portion of the female portion is flared relative to the receiving end and along an axis parallel with its bi-lobal passage, and wherein the enclosing portion of the male portion is flared relative to its male portion and along an axis parallel with its bi-lobal passage, thereby providing a doubly flared shape to the chest buckle when the female portion and the male portion are mated with each other.

13. The pack assembly of claim 11, and wherein the pack includes an anterior portion and a posterior portion, and wherein an inside surface of the anterior portion includes a pocket, and wherein the pocket includes a top edge, a first side, a second side and a bottom side, and wherein the pocket material is made of a stretchable material.

14. The pack assembly of claim 13, and wherein the pocket is wider at the bottom side than at the top edge, and wherein the pocket is divided into two or more sub-pockets.

15. The pack assembly of claim 14, and wherein one of the sub-pockets includes a closure to reversibly secure the top edge of the sub-pocket to the inside surface of the anterior portion of the pack.

16. The pack assembly of claim 11, and wherein the first cord and the second cord form drawstrings that pass through a portion of the fabric of the pack, and wherein the pack includes gussets attached to the fabric of the pack at openings where the drawstrings enter the fabric of the pack.

17. The pack assembly of claim 16, and wherein the pack is formed with seams, and wherein a first seam runs from a first grommet installed at a bottom right portion of the pack to the opening, and wherein a second seam runs from a second grommet at a bottom left portion of the pack to the opening.

18. The pack assembly of claim 11, and wherein the pack includes a pair of grommets in the bottom portion of the pack and through which the respective ends of cords are passed, and wherein the fabric of the pack is a first fabric, and wherein the grommet-bearing portion of the pack is made from a second fabric.

19. The pack assembly of claim 7, wherein the securing lock of the female buckle component includes a rolling element for manual operation.

20. The pack assembly of claim 1, and wherein the female buckle component includes a front surface and a back surface that both lie generally perpendicular to the top and bottom surfaces of the female buckle component, and wherein the front surface and back surface are shaped so as to form a third thickness and a fourth thickness as measured between the front surface and back surface, and wherein the third thickness is smaller than the fourth thickness.

* * * * *